US006695663B2

(12) United States Patent
Ito et al.

(10) Patent No.: US 6,695,663 B2
(45) Date of Patent: Feb. 24, 2004

(54) METHOD FOR MANUFACTURING SPARK PLUG AND APPARATUS FOR CARRYING OUT THE SAME

(75) Inventors: Masato Ito, Aichi (JP); Shinichiro Mitsumatsu, Aichi (JP)

(73) Assignee: NGK Spark Plug Co., LTD, Aichi (JP)

( * ) Notice: Subject to any disclaimer, the term of this patent is extended or adjusted under 35 U.S.C. 154(b) by 0 days.

(21) Appl. No.: 10/058,321

(22) Filed: Jan. 30, 2002

(65) Prior Publication Data

US 2002/0102898 A1 Aug. 1, 2002

(30) Foreign Application Priority Data

Jan. 31, 2001 (JP) ..... 2001-024034

(51) Int. Cl.[7] ..... H01J 9/00
(52) U.S. Cl. ..... 445/4; 445/7
(58) Field of Search ..... 445/4, 7, 64, 67

(56) References Cited

U.S. PATENT DOCUMENTS 5,725,405 A * 3/1998 Nakatani ..... 439/4
5,741,963 A * 4/1998 Nakatani et al. ..... 439/7
6,193,575 B1 * 2/2001 Nakatani ..... 445/4

FOREIGN PATENT DOCUMENTS

| | | |
|---|---|---|
| JP | G58820 | 8/1994 |
| JP | 2000-164320 | 6/2000 |
| JP | 2000-164321 | 6/2000 |
| JP | 2000-164322 | 6/2000 |
| WO | WO 01/933989 A1 | 12/2001 |

* cited by examiner

*Primary Examiner*—Gary Paumen
(74) *Attorney, Agent, or Firm*—Sughrue Mion, PLLC

(57) ABSTRACT

A method for manufacturing a spark plug, which includes photographing a spark gap as to detect the edges of a center and ground electrode and performing a predetermined treatment on the basis of image information obtained from the photographing step. Also disclosed is an apparatus for carrying out the method. In performing the photographing step, an illumination device 200 is disposed opposite a tip portion of a spark plug, in which a spark gap is to be formed, such that illumination rays pass through the spark gap. A camera 4, which is disposed opposite the illumination device 200 with respect to the tip portion of the spark plug, photographs the spark gap formed between a center electrode $W_1$ and a ground electrode $W_2$. In relation to the photographing step, light shields 203 are disposed between a light source 201 of the illumination device (illumination means) 200 and the tip portion of the spark plug to block illumination rays directed toward the tip portion of the spark plug from the light source 201 but which diverge from the spark gap.

8 Claims, 11 Drawing Sheets

METHOD FOR MANUFACTURING SPARK PLUG AND APPARATUS FOR CARRYING OUT THE SAME

BACKGROUND OF THE INVENTION

1. Field of the Invention

The present invention relates to a method for manufacturing a spark plug and an apparatus for carrying out the same.

2. Description of the Related Art

Conventionally, in manufacture of a parallel-electrode-type spark plug, a spark gap is formed and adjusted in the following manner: after a ground electrode is subjected to preliminary pressing, the ground electrode is repeatedly subjected to pressing while the gap is monitored by use of a CCD camera or a like device, until the gap reaches a target value.

3. Problems to be Solved by the Invention

In using a method for calculating a gap on the basis of image information obtained through photographing a tip portion of a spark plug by use of photographing means, such as a CCD camera, the edge of a center electrode and that of a ground electrode must be photographed accurately and sharply in order to obtain the value of a gap at high accuracy. An effective method for attaining this end is as follows: a tip portion of a spark plug is irradiated with light emitted from illumination means which is located opposite the photographing means with respect to the tip portion, to thereby produce a sharp silhouette of the electrodes.

However, when, as mentioned above, light is emitted from the illumination means which is located opposite the photographing means with respect to the tip portion of the spark plug, illumination rays which are directed toward the photographing means in such a manner as to diverge from a spark gap irradiate edge portions of the electrodes due to diffraction after passing through the spark gap. As a result, the edge portions appearing in an obtained image may lose sharpness.

SUMMARY OF THE INVENTION

An object of the present invention is to provide a method for manufacturing a spark plug, capable of photographing a center electrode and a ground electrode such that edges of the electrodes are detected at high accuracy, and capable of manufacturing a spark plug at high accuracy on the basis of a photographed image of the electrodes, as well as to provide an apparatus for carrying out the same.

The above object of the present invention is achieved by providing a method for manufacturing a spark plug comprising a center electrode disposed within an insulator, a metallic shell disposed outside the insulator, and a ground electrode, one end of the ground electrode being joined to an end face of the metallic shell, an opposite end portion of the ground electrode being bent such that a side surface of the opposite end portion faces an end face of the center electrode so as to form a spark gap between the side surface and the end face, the method comprising:

a photographing step for photographing the spark gap by use of photographing means disposed at a position for receiving illumination rays which are emitted from illumination means so as to be restrained in divergence from the spark gap and which have passed through the spark gap; and an after-treatment step for performing a predetermined treatment on the basis of image information obtained from the photographing step.

The present invention further provides an apparatus for carrying out the method.

In more detail, a light shield can be used to block out illumination rays which are directed toward the photographing means so as to diverge from a spark gap after passing through the spark gap, thereby effectively preventing reflections of the illumination rays (i.e., effectively preventing reflections from an edge portion of the surface of the center electrode facing the photographing means and reflections from an edge portion of the surface of the ground electrode facing the photographing means). Specifically, as shown in FIG. 12(*a*), illumination rays which enter the spark gap at a greater incident angle (specifically, at a greater incident angle with respect to a direction perpendicular to the axial direction of the center electrode) are more likely to directly irradiate an exit edge portion of an electrode when passing through the spark gap. Thus, the diffraction of illumination rays passing through the spark gap becomes noticeable toward the surfaces of the electrodes facing the photographing means. As a result, the image thus obtained loses sharpness of the edge portions. In FIGS. 12(*a*) and 12(*b*), the x direction is the direction along which the illumination means and the photographing means face each other, and the y direction is the axial direction of the center electrode.

The light shield can also be a mask having an aperture having either a fixed or variable opening. A collimating lens can be used in combination with a mask having an aperture in a preferred embodiment, where the mask blocks diverging illumination rays.

The above-described method enables easy adjustment of the axial distance of an emission region through which illumination rays are emitted. The axial distance of the emission region can be adjusted so as to be suited for the spark gap. Since illumination rays which enter the spark gap at a large angle can be blocked out, only parallel rays as shown in FIG. 12(*b*) or near parallel rays pass through the spark gap, thereby restraining reflections of diffracted rays from the edge portions of the electrodes facing the photographing means. The image thus obtained provides highly accurate silhouettes of the center and ground electrodes, thereby enabling an accurate value of the gap to be determined.

Alternatively, illumination rays may be emitted so as to pass by a light shield disposed between the spark gap and a light source provided on the illumination means. Emission of illumination rays via the light shield enables a desired illumination range to be attained regardless of the size of the light source. Further, the following arrangement may be employed: light shields are disposed along the axial direction of a spark plug on axially opposite sides of the spark gap so as to define therebetween an emission region for allowing illumination rays to pass through; and the distance as measured along the axial direction between the edges of the light shields which face the emission region is adjusted to 0.5 mm to 30 mm. This adjustment effectively restrains reflections of diffracted rays from the edge portions of the electrodes while maintaining a sufficient quantity of light for obtaining an image of the center and ground electrodes. When the axial distance of the emission region is less than 0.5 mm, the quantity of light is insufficient for obtaining the image. When the axial distance is in excess of 30 mm, illumination rays which enter the spark gap at a large incident angle increase, potentially causing an increase in the amount and range of reflections from the exit edge portions of the electrodes. Such adjustment prevents these problems.

Further, parallel rays emitted from a parallel-ray emission means may be employed so as to restrain divergence of illumination rays from the spark gap. Since illumination rays enter the spark gap at an incident angle of substantially zero, illumination rays that directly irradiate an exit edge portion of an electrode can be greatly reduced, thereby effectively restraining diffraction of rays around the edge portion.

DESCRIPTION OF REFERENCE NUMERALS

1: apparatus for manufacturing spark plug
W: workpiece (spark plug)
$W_1$: center electrode
$W_2$: ground electrode
$W_3$: metallic shell
g: spark gap
4: camera (photographing means)
15: main bending unit (gap adjustment means)
200: illumination device (illumination means)

DETAILED DESCRIPTION OF THE PREFERRED EMBODIMENTS

Embodiments of the present invention will next be described with reference to the drawings. However, the present invention should not be construed as being limited thereto.

Figure 1A:
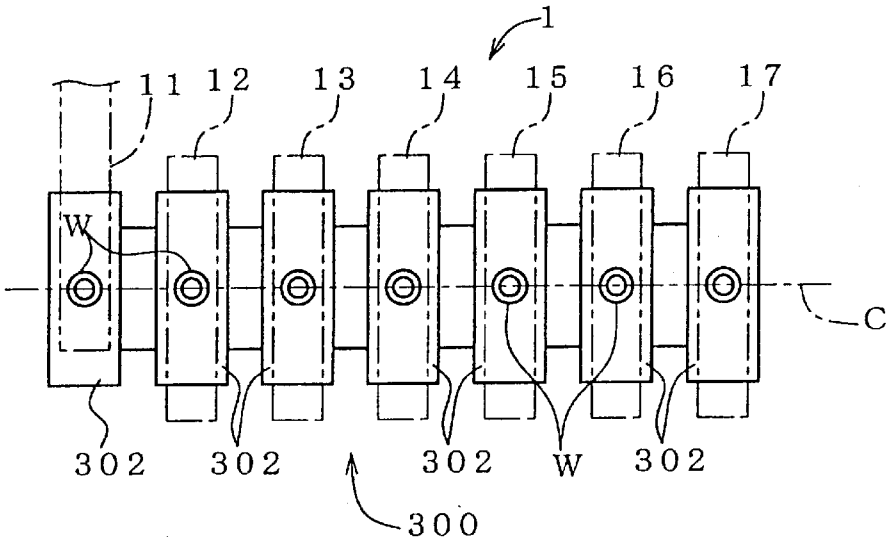
FIGS. 1(*a*) and 1(*b*) are plan and side views, respectively, showing schematically an embodiment of an apparatus for manufacturing a spark plug of the present invention.
Figure 1B:
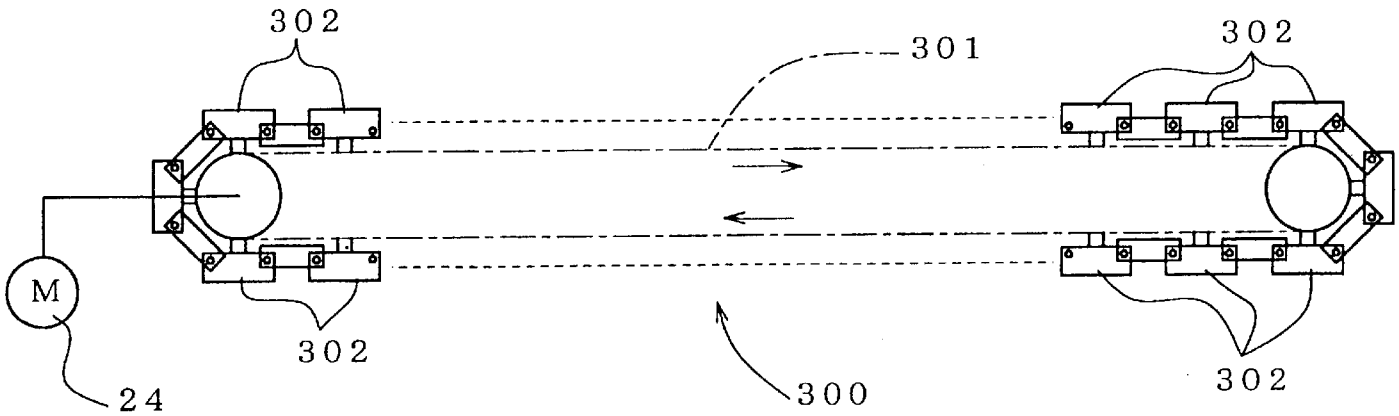

FIGS. 1(*a*) and 1(*b*) are a plan view and a side view, respectively, schematically showing an embodiment of an apparatus for manufacturing a spark plug (hereinafter, also referred to as a manufacturing apparatus) of the present invention. A manufacturing apparatus 1 includes a linear conveyor 300, which serves as a conveyance mechanism for intermittently conveying spark plugs to undergo working (hereinafter, also called a workpiece) W along a conveyance path C (a linear path in the present embodiment). Working stations for forming a spark gap of a workpiece W; i.e., a workpiece loading mechanism 11 for loading a spark plug to undergo working; a ground electrode positioning mechanism 12 for positioning the ground electrode of the workpiece W at a predetermined position; a tip face position measuring unit 13 for measuring the position of the tip face of a center electrode; a preliminary bending unit 14 for preliminarily bending the ground electrode; a main bending unit 15 for performing main bending work on the ground electrode; a workpiece ejection mechanism 16 for ejecting the workpiece W which has undergone the bending work; and a rejected-product ejection mechanism 17, are arranged in this order in the direction of conveyance along the conveyance path C. The linear conveyor 300 includes a chain 301, which serves as a circulating member, and carriers 302, which are removably loaded with the corresponding workpieces W and are attached to the chain 301 at predetermined intervals. As the chain 301 is intermittently driven in a circulating condition by means of a conveyor drive motor 24, the carriers 302; i.e., the workpieces W, are intermittently conveyed along the conveyance path C.

Figure 2:
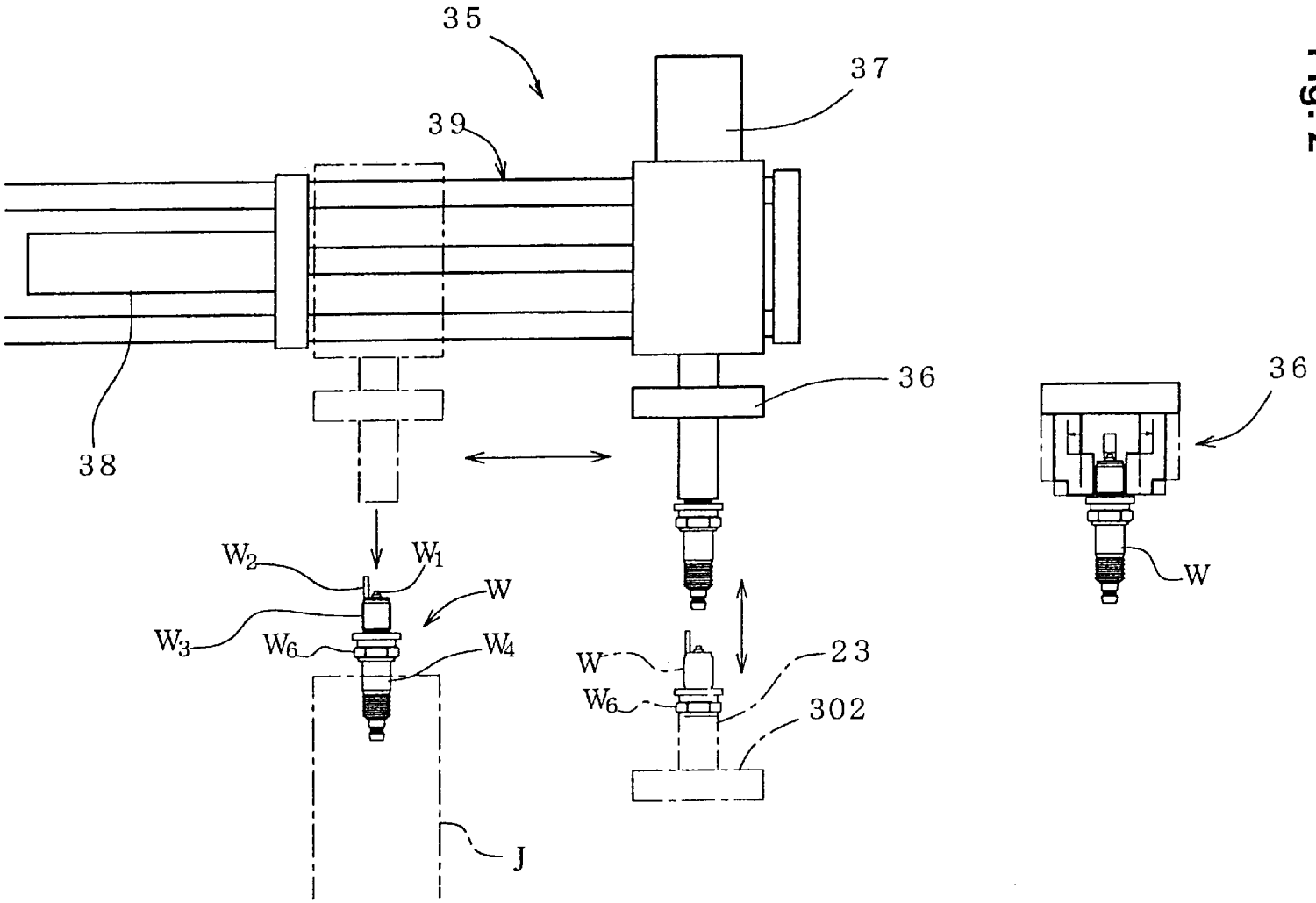
FIG. 2 is an explanatory view showing a transfer mechanism.

As shown in FIG. 2, the workpiece W includes a cylindrical metallic shell $W_3$; an insulator $W_4$, which is fitted into the metallic shell $W_3$ such that front and rear end portions thereof project from the metallic shell $W_3$; a center electrode $W_1$, which is axially inserted into the insulator $W_4$; and a ground electrode $W_2$, whose one end is joined to the metallic shell $W_3$ by welding or a like process and which extends along the axial direction of the center electrode $W_1$. The ground electrode $W_2$ undergoes bending work, which will be described later. In this bending work a free end portion thereof is bent toward the tip face of the center electrode $W_1$ so as to form a spark gap, whereby the workpiece W becomes a parallel-electrode-type spark plug. A cylindrical holder 23 is integrally mounted on the top surface of each carrier 302 such that the top end thereof is open. The workpiece W is removably inserted, from a rear end thereof, into the holder 23. A hexagonal portion $W_6$ of the metallic shell $W_3$ is supported by a circumferential edge portion of an opening of the holder 23. Thus, the workpiece W is conveyed in a standing condition on the carrier 302 while the ground electrode $W_2$ faces up.

The workpiece loading mechanism 11, the workpiece ejection mechanism 16, and the rejected-product ejection mechanism 17 shown in FIG. 1 are each configured in the form of, for example, a transfer mechanism as shown in FIG. 2 for transferring the workpiece W between a workpiece supply section or a workpiece ejection section (provided at position J in FIG. 2) located laterally away from the conveyance path C of the linear conveyor 300 (FIG. 1) and the holder 23 which is positioned within the loading or ejection mechanism. The transfer mechanism 35 includes a chuck hand mechanism 36, which is held so as to be vertically movable through activation by an air cylinder 37, and a reciprocative drive mechanism 39 for causing the chuck hand mechanism 36 to reciprocate in a radial direction of a circumferential path C by use of an air cylinder 38.

Figure 3:
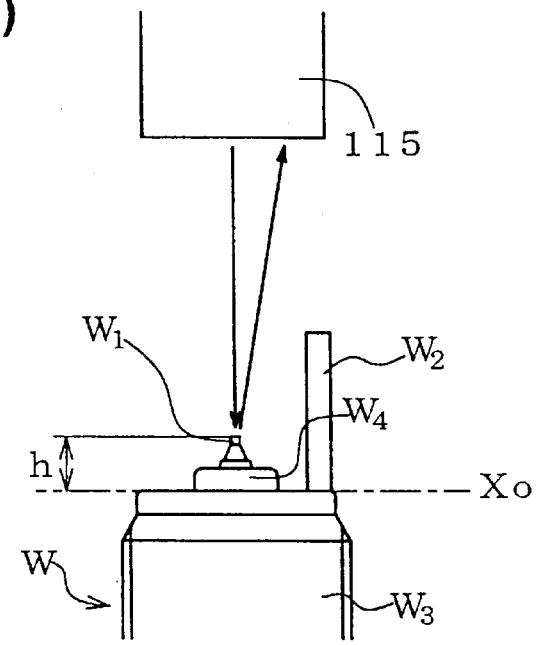
FIGS. 3(*a*), 3(*b*) and 3(*c*) are views showing the concept of operation of a tip face position measuring unit and a preliminary bending unit.
Figure 3:
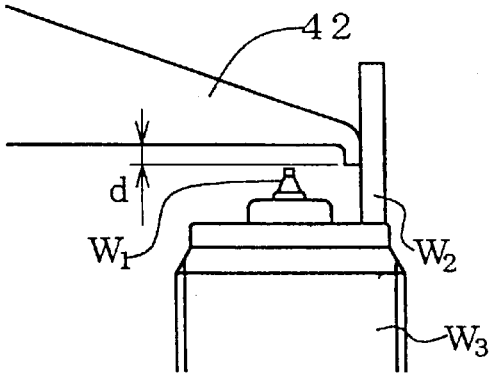
Figure 3:
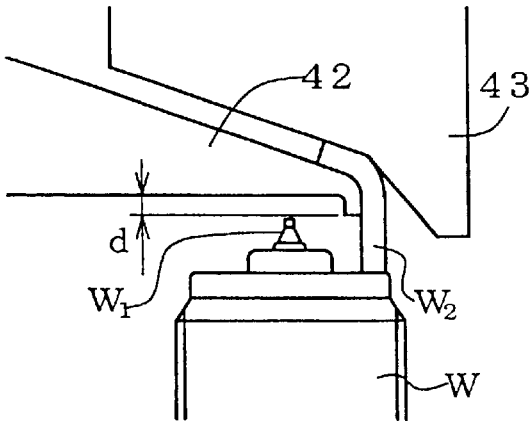

The ground electrode positioning mechanism 12 is adapted to position the ground electrode $W_2$ at a predetermined position by rotating a spark plug with an actuator, such as a motor. The tip face position measuring unit 13 measures the position of the tip face of the center electrode $W_1$ prior to preliminary bending, which will be described later, and includes a position sensor 115 as shown in FIG. 3(*a*). The workpiece W is held, in a standing condition with the ground electrode $W_2$ facing up, by the holder 23, which is mounted on the linear conveyor 300 to thereby be fixed in height. The position sensor 115 (e.g., a laser displacement sensor) is held at a constant height by a frame used for measuring the height of the tip face and thus measures the position of the tip face of the center electrode $W_1$ of a loaded workpiece W.

Referring to FIGS. 3(*b*) and 3(*c*), in operation of the preliminary bending unit 14, a preliminary bending spacer 42 is positioned, on the basis of the position of the tip face of the center electrode $W_1$ of the workpiece W detected by the position sensor 115, such that a substantially constant gap d is formed between the tip face and the bottom of the preliminary bending space 42. Then, a free end portion of the ground electrode $W_2$ is pressed against the preliminary bending spacer 42 using a bending punch 43 such that the free end portion faces the center electrode $W_1$ via the preliminary bending spacer 42. The bending punch 43 is driven by an unillustrated punch drive unit, such as an air cylinder, so as to move toward and away from the ground electrode $W_2$ for preliminary bending. While the preliminary bending spacer 42 is positioned such that it does not contact the tip face of the center electrode $W_1$; i.e., a predetermined gap d is formed between the preliminary bending space 42 and the tip face, the bending punch 43 presses the ground electrode $W_2$ against the preliminary bending spacer 42 to thereby carry out preliminary bending of the ground electrode $W_2$. Thus, the electrodes are unlikely to suffer a defect, such as a chip or a scratch, with resultant attainment of high yield.

Figure 4:
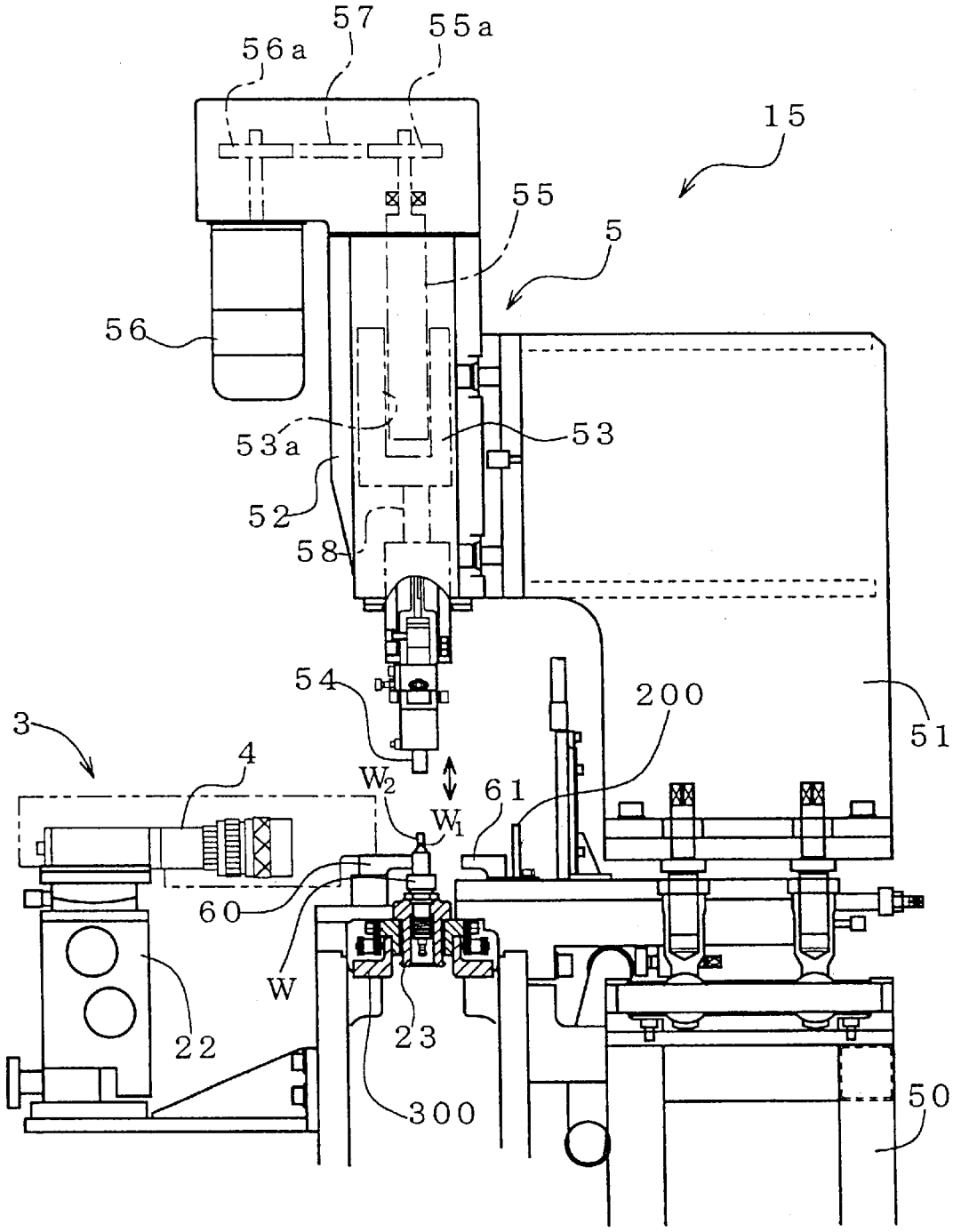
FIG. 4 is a front view showing an example of a main bending unit.

FIG. 4 shows an example of the main bending unit 15. The workpiece W is introduced into the main bending unit 15 by means of the linear conveyor 300 and is then positioned at a predetermined working position. A gap photographing-analyzing unit 3 and a bending mechanism 5, which mainly constitutes gap adjustment means, are disposed on opposite sides of the conveyance path of the linear conveyor 300 such that the unit 3, the mechanism 5, and the working position for the workpiece W are aligned.

The gap photographing-analyzing unit (hereinafter, also called a photographing-analyzing unit) 3 is mainly used for photographing and includes a camera 4, which is supported on a frame 22 and serves as photographing means, and an unillustrated analyzer connected to the camera 4. The analyzer may include an I/O port and components connected to the I/O port, such as a CPU, a ROM, and a RAM. The camera 4 assumes the form of, for example, a CCD camera which includes a two-dimensional CCD sensor as an image detector, and is adapted to laterally photograph the center electrode $W_1$ of a workpiece, the ground electrode $W_2$, which faces the center electrode $W_1$, and a spark gap g formed between the center electrode $W_1$ and the ground electrode $W_2$.

In FIG. 4, the bending mechanism 5 is configured, for example, such that a body casing 52 is attached to the front end face of a cantilever frame 51 mounted on a base 50 of the unit. A movable base 53 is accommodated within the body casing 52 in a vertically movable condition. A press punch 54 is attached to the movable base 53 via a rod 58 so as to project from the bottom end face of the body casing 52. A screw shaft (e.g., a ball screw) 55 is screw-engaged from above with a female screw portion 53*a* of the movable base 53. The screw shaft 55 is rotated in regular and reverse directions by means of a press punch drive motor 56 to thereby move the press punch 54 toward and away from the ground electrode $W_2$ of the workpiece W. Also, by stopping the screw shaft drive, the press punch 54 can be held at any height corresponding to a stop position. The rotating force of the press punch drive motor 56 is transmitted to the screw shaft 55 via a timing pulley 56*a*, a timing belt 57, and a timing pulley 55*a*.

Figure 11:
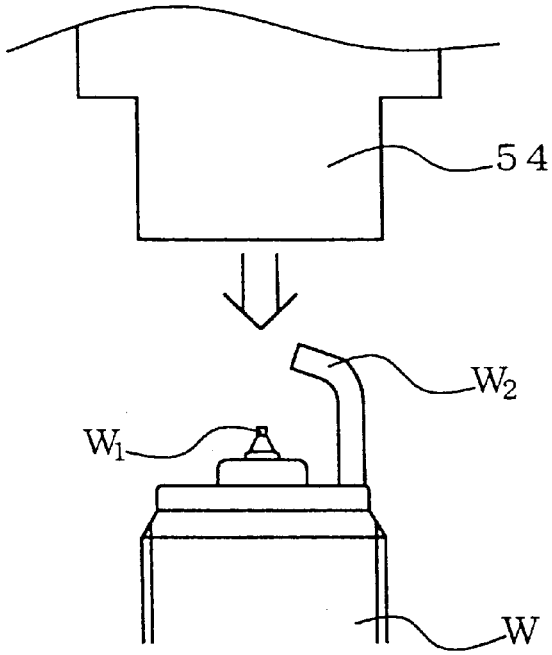
FIGS. 11(*a*) and 11(*b*) are explanatory views showing conceptually an example of a gap adjustment step.
Figure 11:
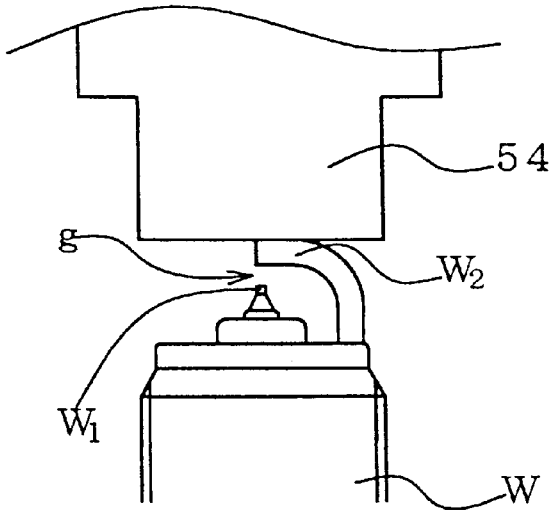
Figure 12:
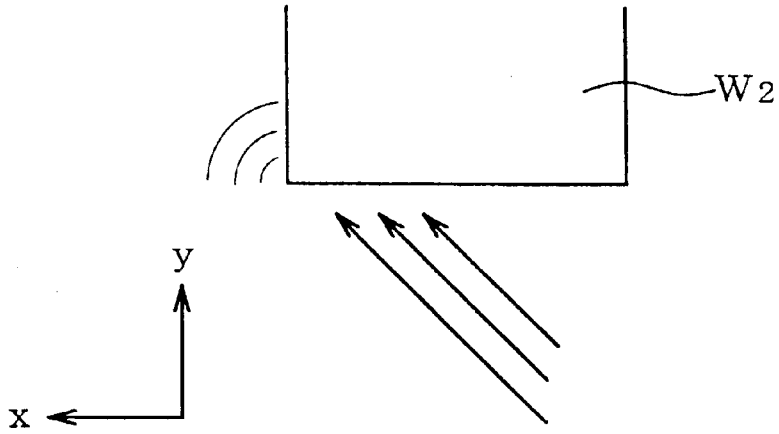
FIGS. 12(*a*) and 12(*b*) are explanatory views conceptually explaining entry of illumination rays into a gap.
Figure 12:
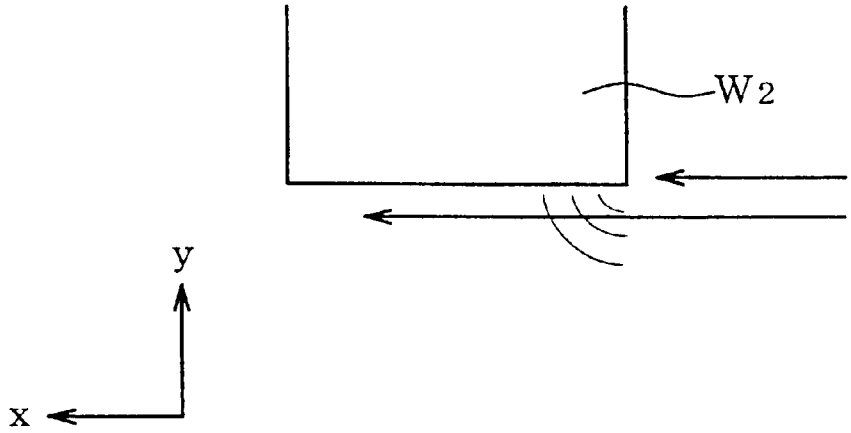

As shown in FIGS. 11(*a*) and 11(*b*), the press punch 54 is caused to approach and press the ground electrode $W_2$ which is preliminarily bent, for example, such that the free end thereof faces obliquely upward, thereby performing main bending work (a gap adjustment step) such that a free end portion of the ground electrode $W_2$ becomes substantially parallel to the tip face of the center electrode $W_1$, and adjusting the spark discharge gap to a target value. As shown in FIG. 4, while main bending work is performed, the workpiece W is fixedly held, from opposite sides with respect to the axial direction, between holder members 60 and 61.

Figure 5:
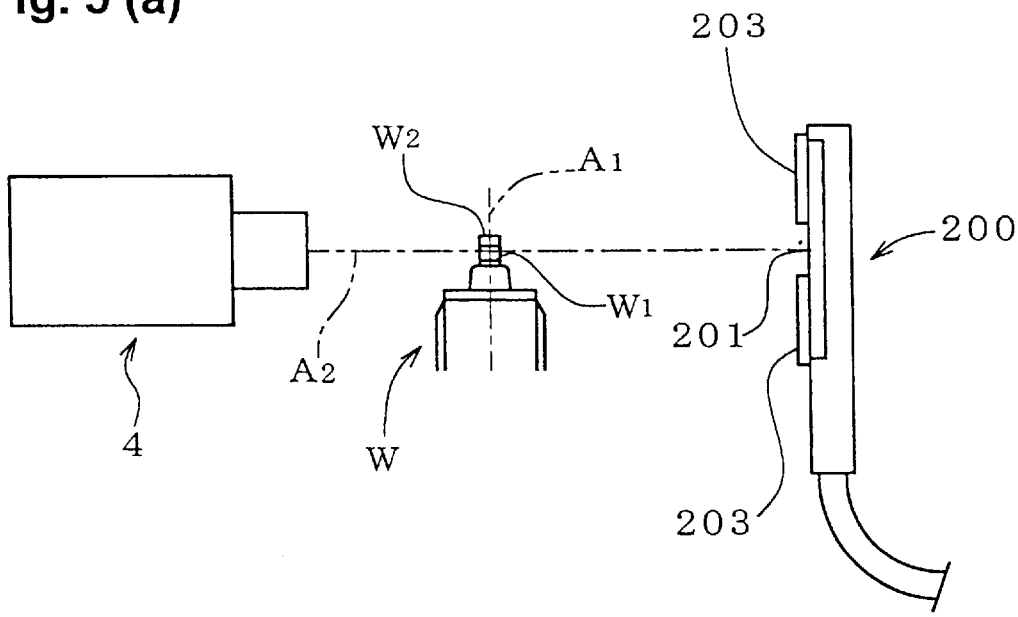
FIGS. 5(*a*) and 5(*b*) are explanatory views showing conceptually an example of a photographing step.
Figure 5:
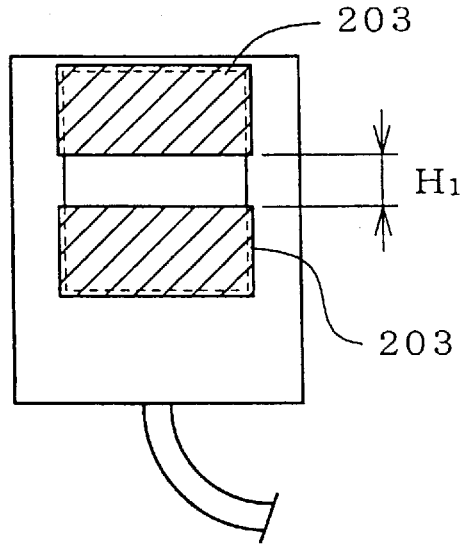
Figure 6:
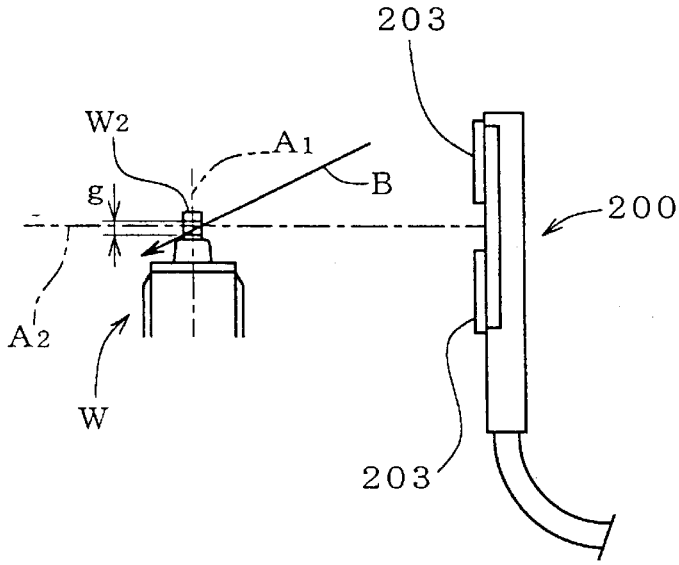
FIG. 6 is an explanatory view explaining conceptually the effect of light shields.

Next, a photographing step for obtaining image information to be used in main bending work (a gap adjustment step) will be described in detail. As shown in FIG. 5(*a*), in order to perform the photographing step, an illumination device 200 is disposed opposite a tip portion of the workpiece W (spark plug), in which a spark gap is to be formed, such that illumination rays pass through the spark gap. The embodiment of FIG. 5 employs a planar-light-emission-type illumination device. The camera 4, which is disposed opposite the illumination device 200 with respect to the tip portion of the spark plug, photographs the spark gap formed between the center electrode $W_1$ and the ground electrode $W_2$. In relation to the photographing step, light shields 203 are disposed between a light source 201 of the illumination device 200 and the tip portion of the spark plug in order to partially block out illumination rays which are directed toward the tip portion of the spark plug from the light source 201 but which diverge from the spark gap. Herein, the illumination rays which diverge from the spark gap refer to illumination rays which are directed to the tip portion of the spark plug from the light source but which do not pass through the spark gap in the lateral direction (the lateral direction refers to the direction perpendicular to the axial direction $A_1$ (in FIG. 6, the direction represented by the dash-and-dot line $A_2$)). Accordingly, as shown in FIG. 6, most illumination rays which would otherwise pass through the spark gap g in an oblique direction (e.g., the direction of arrow B) are blocked by the light shields 203.

The light shield 203 is disposed on at least one side of a spark gap with respect to the axial direction of a center electrode. However, in the embodiment of FIG. 5, the light shields 203 are disposed on opposite sides of the spark gap with respect to the axial direction of the center electrode so as to define therebetween an emission region for allowing illumination rays to pass through. Further, as shown in FIG. 5(*b*), the distance $H_1$ as measured along the axial direction between edges of the light shields 203 which face the emission region is adjusted to 0.5 mm to 30 mm. In the present embodiment, the distance $H_1$ is adjusted to 20 mm. The mutually facing edges of the light shields 203 are parallel to each other.

Figure 7:
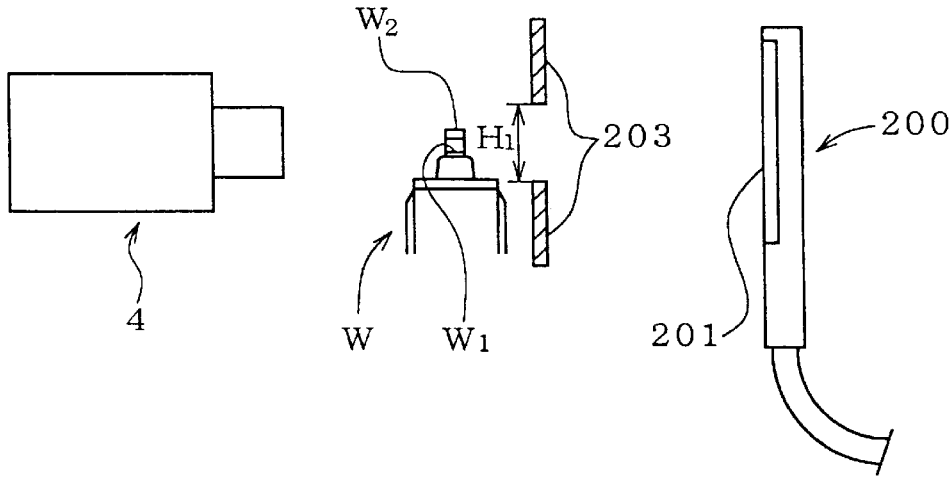
FIG. 7 is an explanatory view showing a modification of FIGS. 5(*a*) and 5(*b*).

In FIG. 5, the light shields 203 are disposed in the vicinity of the light source 201 (specifically, for example, so as to cover the light-emitting face of the light source 201 in a contact or near contact state). However, the present invention is not limited thereto. The light shields 203 may be disposed at an intermediate position between the workpiece W and the light source 201. In FIG. 7, the light shields 203 are disposed at a position biased toward the workpiece W (specifically, in the vicinity of the workpiece W).

Figure 8:
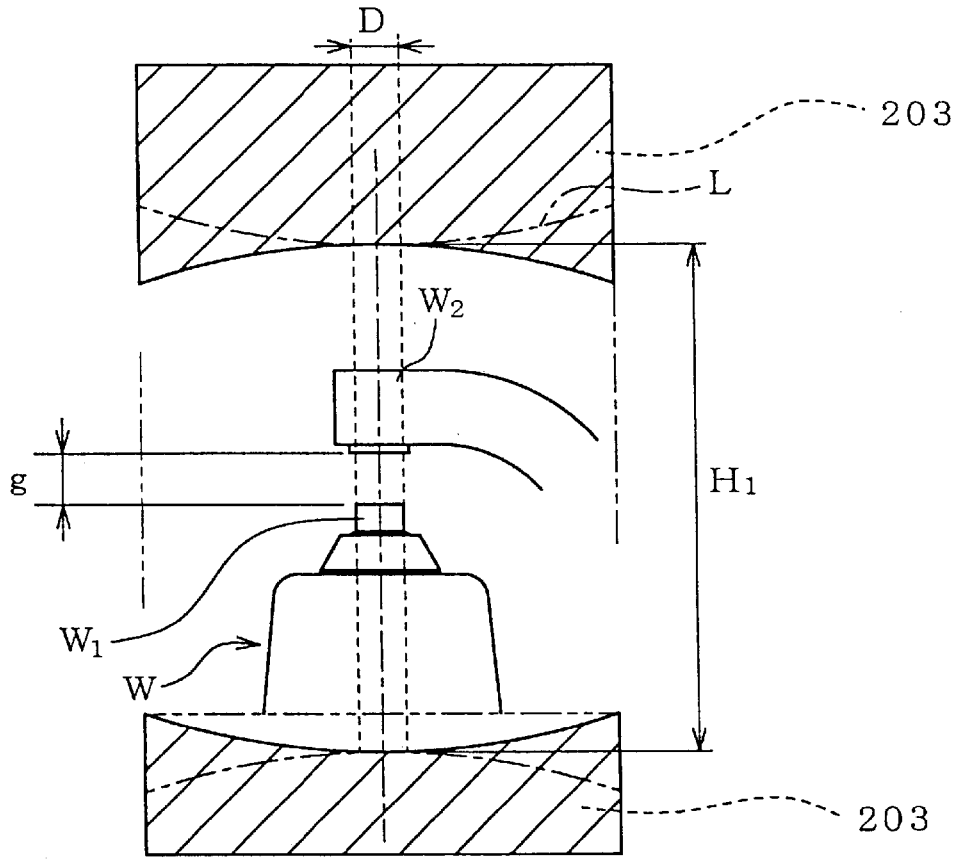
FIG. 8 is a view that shows modified edge shapes of the light shields.

In FIG. 8, the light shields 203 are used in a manner similar to that of FIG. 5 or FIG. 7 except that the edges thereof are not parallel to each other. In this case, preferably, the edge-to-edge distance $H_1$ is 0.5 mm to 30 mm as measured within a section corresponding to the width of the tip face of the center electrode in an image as projected orthogonally on a virtual plane parallel to the axial direction and whose normal extends parallel to the facing direction of a photographing device and illumination means. In FIG. 8, the edge-to-edge distance is 0.5 mm to 30 mm as measured along the axial direction within a section corresponding to the width D of the center electrode (the width direction of the center electrode is perpendicular to the axial direction). In FIG. 8, the edges are curved such that the distance therebetween increases. However, when, as represented by the dash-and-dot line L, the edges are curved such that the distance therebetween decreases, or in the case of any other shape of the edges, the edge-to-edge distance can be similarly determined.

Figure 9:
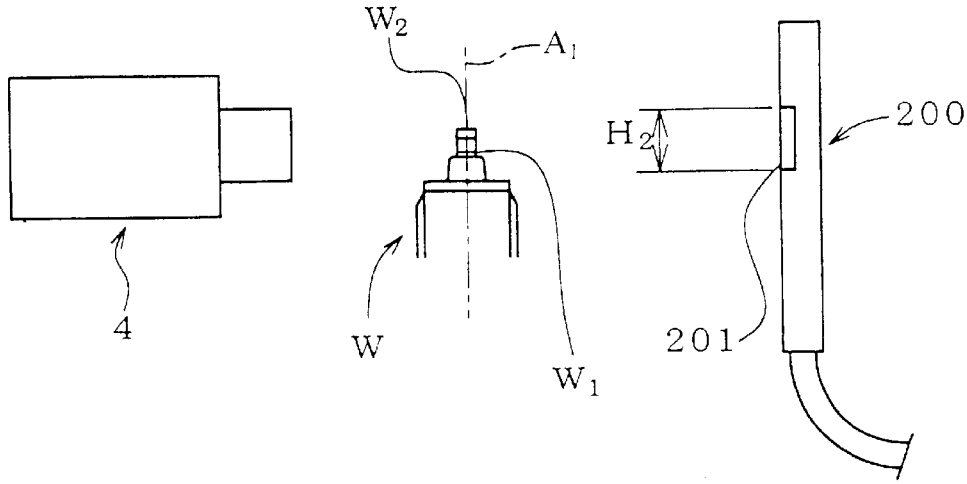
FIGS. 9(*a*) and 9(*b*) are explanatory views showing another modified example of FIGS. 5(*a*) and 5(*b*).
Figure 9:
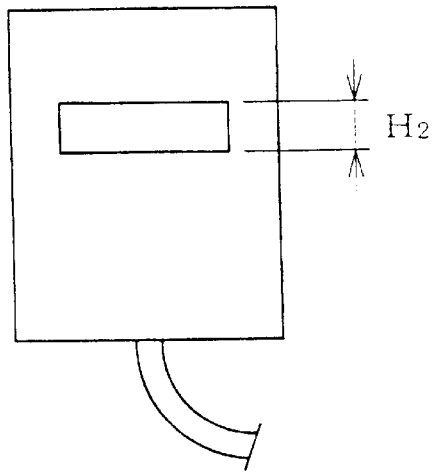

As shown in FIG. 9(*a*), instead of adjusting the width of an emission region by means of light shields, the width of a light source (emission face) itself may be adjusted. Referring to FIGS. 9(*a*) and 9(*b*), in the light source of the illumination device 200 used in the photographing step, instead of using light shields, the emission region through which illumination rays are emitted is adjusted to 0.5 mm to 30 mm in distance $H_2$ as measured along the axial direction of the center electrode. Also in this case, as shown in FIG. 9(*b*), when the edges of the light source are parallel to the direction perpendicular to the axial direction of the center electrode, the edge-to-edge distance can be set so as to fall within the above-mentioned range. Also, as in the case of FIG. 8, when the edges of the emission face are not parallel to each other, the edge-to-edge distance can be determined by a method similar to that of FIG. 8. In this case, in place of the edge-to-edge distance of the light shields, the edge-to-edge distance of the emission face is adjusted in a manner similar to that of FIG. 8 (i.e., the edge-to-edge distance of the emission face is adjusted to 0.5 mm to 30 mm as measured along the axial direction within a section corresponding to the width of the center electrode).

Figure 10:
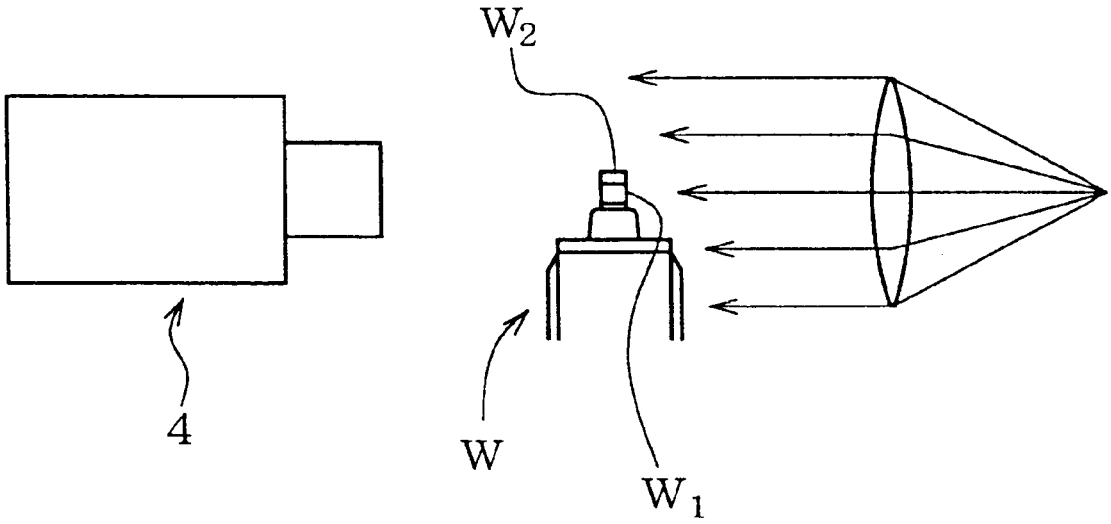
FIG. 10 is an explanatory view showing an example in which parallel-ray emission means is used as illumination means.

The present embodiment uses a halogen lamp as illumination means. However, an LED, a sodium lamp, or the like may be used. Also, the illumination means may be parallel-ray emission means for emitting parallel rays toward the tip end portion of the spark plug. The parallel-ray emission means may be configured, for example, such that parallel rays are emitted using fine slits. Specifically, optical conversion means may be used for converting diffuse rays to parallel rays. The optical conversion means may assumes the form of a louver having fine slits arranged at very fine intervals. The present invention is not limited thereto. For example, a collimator or like device may be used for emitting parallel rays, or a light source of very high directivity, such as a laser beam, may be used. FIG. 10 shows an example in which rays emitted from a point light source are converted to parallel rays using a convex lens. The parallel-ray emission means may be combined with an illumination form in which light shields are provided as shown in FIGS. 5, 7, and 8 or with an illumination form in which the width of emission of a light source itself is adjusted as shown in FIG. 9.

On the basis of image information obtained from the above-described photographing step, a gap adjustment step, which serves as the after-treatment step, is performed for adjusting the spark gap. The gap adjustment step is performed using the main bending unit 15 in the following manner. As shown in FIG. 11(*b*), the press punch 54 (which, as shown in FIG. 11(*a*), is caused by an unillustrated drive unit, such as a screw shaft mechanism, to vertically move toward and away from the ground electrode $W_2$ of the workpiece W positioned within the main bending unit 15) performs main bending work on the ground electrode $W_2$. The ground electrode $W_2$ is preliminarily bent such that the free end thereof faces obliquely upward. In the main bending work a free end portion of the ground electrode $W_2$ is made substantially parallel to the tip face of the center electrode $W_1$. The main bending work is carried out while the spark gap is being monitored using the camera 4. On the basis of image information obtained from the photographing step, the spark discharge gap g is adjusted to a predetermined value. The press punch 54 is provided with a load cell at its tip. Upon detection of contact with an outside electrode, the press punch 54 performs bending work by an amount of displacement as instructed by an image unit (the analyzer mentioned previously), which is electrically connected to the camera 4 and which performs size measurement, etc. Notably, various specific methods are available for adjusting the spark gap on the basis of image information obtained from the photographing step. For example, a method for adjusting the spark gap in a stepwise manner as disclosed in Japanese Patent Application Laid-Open (kokai) No. 2000-164322 may be employed.

The after-treatment step is not limited to a gap adjustment step. For example, a defect control step for controlling defects on the basis of an image obtained through photographing may be employed. The defect control step may be implemented as a defective-product rejection step in which a product whose photographed image fails to conform to the criteria for a conforming product is rejected as a nonconforming product. In this case, since a nonconforming product is rejected after the edge condition is judged, an error in discriminating between conforming and nonconforming products with respect to shape is greatly reduced. Also, a product data generation step may be employed in which product data regarding a photographed product are generated on the basis of an image of the product obtained by photographing. The product data generation step may employ the following method. For example, when a photographed product is judged defective from an image of the product obtained by photographing, information about the defect in the photographed product (information about whether or not defect is present, information about the type of defect, etc.) and basic product information regarding the photographed product (product No. date of inspection, lot No., etc.) are stored in a correlated database. Thus, statistical control can be performed while conforming and nonconforming products are discriminated from each other at high accuracy.

It should further be apparent to those skilled in the art that various changes in form and detail of the invention as shown and described above may be made. It is intended that such changes be included within the spirit and scope of the claims appended hereto.

This application is based on Japanese Patent Application No. 2001-24034 filed Jan. 31, 2001, the disclosure of which is incorporated herein by reference in its entirety.

What is claimed is:

1. A method for manufacturing a spark plug comprising a center electrode disposed within an insulator, a metallic shell disposed outside the insulator, and a ground electrode, one end of the ground electrode being joined to an end face of the metallic shell, an opposite end portion of the ground electrode being bent such that a side surface of the opposite end portion faces an end face of the center electrode so as to form a spark gap between the side surface and the end face, said method comprising:

photographing the spark gap with photographing means disposed at a position for receiving illumination rays which are emitted from illumination means in a manner which restrains divergence of illumination rays passing through the spark gap due to interaction with edges of the ground and/or center electrodes;

disposing a light shield between the spark gap and a light source of the illumination means; and performing a predetermined treatment on the basis of image information obtained from said photographing step.

2. The method for manufacturing a spark plug as claimed in claim 1, which comprises disposing at least two light shields along an axial direction of the spark plug on axially opposite sides of the spark gap so as to define therebetween an emission region for allowing the illumination rays to pass through, and wherein a distance as measured along the axial direction between edges of the light shields which face the emission region is adjusted to 0.5 mm to 30 mm.

3. The method for manufacturing a spark plug as claimed in claim 1, wherein said illumination means comprises a light source having an emission region of 0.5 mm to 30 mm as measured along the axial direction of the spark plug.

4. The method for manufacturing a spark plug as claimed in claim 1, wherein the illumination rays emitted from the illumination means are parallel rays and the illumination means comprises parallel-ray emission means.

5. An apparatus for manufacturing a spark plug comprising a center electrode disposed within an insulator, a metallic shell disposed outside the insulator, and a ground electrode, one end of the ground electrode being joined to an end face of the metallic shell, an opposite end portion of the ground electrode being bent such that a side surface of the opposite end portion faces an end face of the center electrode so as to form a spark gap between the side surface and the end face, said apparatus comprising:

illumination means for emitting illumination rays in a manner which restrains divergence of illumination rays passing through the spark gap due to interaction with edges of the ground and/or center electrodes;

a light shield disposed between the spark gap and a light source of said illumination means;

photographing means disposed at a position for receiving the illumination rays which have passed through the spark gap; and after-treatment means for performing a predetermined treatment on the basis of image information obtained from said photographing means.

6. The apparatus for manufacturing a spark plug as claimed in claim 5, which comprises at least two light shields disposed along an axial direction of the spark plug on axially opposite sides of the spark gap so as to define therebetween an emission region for allowing the illumination rays to pass through, and wherein a distance as measured along the axial direction between edges of the light shields which face the emission region is adjusted to 0.5 mm to 30 mm.

7. The apparatus for manufacturing a spark plug as claimed in claim 5, said illumination means comprising a light source having an emission region of 0.5 mm to 30 mm as measured along the axial direction of the spark plug.

8. The apparatus for manufacturing a spark plug as claimed in claim 5, wherein the illumination rays emitted from said illumination means are parallel rays and the illumination means comprises parallel-ray emission means.

* * * * *